US007361022B2

(12) United States Patent
Ju

(10) Patent No.: US 7,361,022 B2
(45) Date of Patent: Apr. 22, 2008

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/474,263

(22) Filed: Jun. 26, 2006

(65) Prior Publication Data

US 2007/0298625 A1 Dec. 27, 2007

(51) Int. Cl.
*H01R 12/00* (2006.01)

(52) U.S. Cl. ..... 439/66

(58) Field of Classification Search ..... 439/66, 439/692

See application file for complete search history.

(56) References Cited

U.S. PATENT DOCUMENTS 4,056,300 A * 11/1977 Schumacher ..... 439/692
4,593,961 A * 6/1986 Cosmo ..... 439/66
5,370,540 A * 12/1994 Kobayashi ..... 439/78
6,267,622 B1 * 7/2001 Nagata ..... 439/603
6,899,550 B2 * 5/2005 Perugini et al. ..... 439/74
6,971,889 B2 * 12/2005 Harper et al. ..... 439/83
2006/0094263 A1 * 5/2006 Chen et al. ..... 439/66

* cited by examiner

*Primary Examiner*—Tulsidas C. Patel
*Assistant Examiner*—Phuongchi Nguyen
(74) *Attorney, Agent, or Firm*—Troxell Law Office, PLLC

(57) ABSTRACT

The present invention discloses an electrical connector, which may reduce the stress concentration and elastic fatigue of conductive terminals and increase the normal contact force of conductive terminals. To achieve the objects described above, an electrical connector according to the present invent comprises an electrical insulating body provided with a plurality of accommodating holes; at least one conductive terminal received in the terminal accommodating hole; and an elastic plastics disposed between the conductive terminal and the accommodating hole. Compared with the conventional art, the electrical connector according to the present invention may reduce the stress concentration and elastic fatigue of conductive terminals and increase the normal contact force of conductive terminals.

2 Claims, 4 Drawing Sheets

ELECTRICAL CONNECTOR

FIELD OF THE INVENTION

The present invention relates to an electrical connector, and in particular to an electrical connector provided with an elastic plastics.

BACKGROUND OF THE INVENTION

Conventional electrical connector, the China Patent No CN200420088694.0 for example, as shown in FIG. 1, generally comprises an electrical insulating body 10 provided with a plurality of accommodating holes 10 and a conductive terminal provided in the electrical insulating body 10, wherein the wall of the accommodating hole comprises a vertical portion 100 and an inclined portion 101. The conductive terminal 2 has a certain degree of elasticity and is a straight rod. The conductive terminal 2 is arranged in the electrical insulating body 1 and secured by a stop block 11 with the conductive terminal's both ends extending out of the upper and lower surfaces of the electrical insulating body 1 to form an upper and lower contact points 21 and 22. The conductive terminal 2 is deformed under the pressure of the chip module, 2' in FIG. 1 for example, and is abutted against the interface between the inclined portion 101 of the accommodating hole 10 and the upper surface of the electrical insulating body 1. The conductive terminal described above shows a larger extent of elastic fatigue, higher stress concentration, and lower normal contact force.

Consequently, it is necessary to design a new electrical connector to overcome the shortcomings described above.

SUMMARY OF THE INVENTION

An object of the present invention is to provide an electrical connector, which may reduce the stress concentration and elastic fatigue of conductive terminals and increase the normal contact force of the conductive terminals.

To achieve the objects described above, an electrical connector according to the present invention comprises an electrical insulating body provided with a plurality of accommodating holes; at least one conductive terminal received in the terminal accommodating hole; and an elastic plastics disposed between the conductive terminal and the accommodating hole.

Compared with the conventional art, the electrical connector according to the present invention may reduce the stress concentration and elastic fatigue of conductive terminals and increase the normal contact force of the conductive terminals.

BRIEF DESCRIPTION OF THE DRAWINGS

The present invention can be more fully understood by reference to the following description and accompanying drawings, in which.

DETAILED DESCRIPTION OF THE INVENTION

Figure 1:
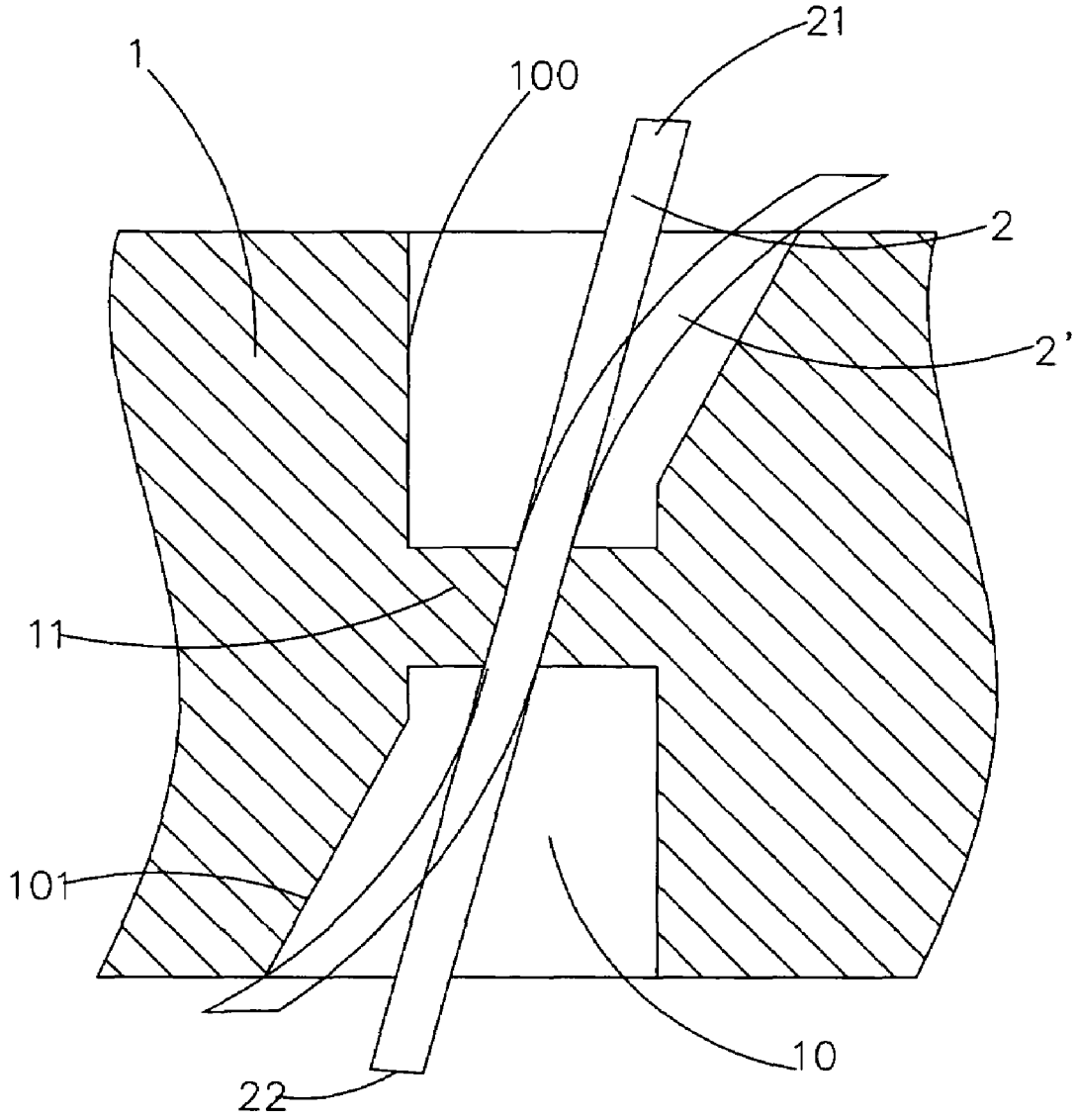
(PRIOR ART) FIG. 1
FIG. 1 schematically illustrates a local cross-sectional view of a conventional conductive terminal and electrical insulating body.
Figure 2:
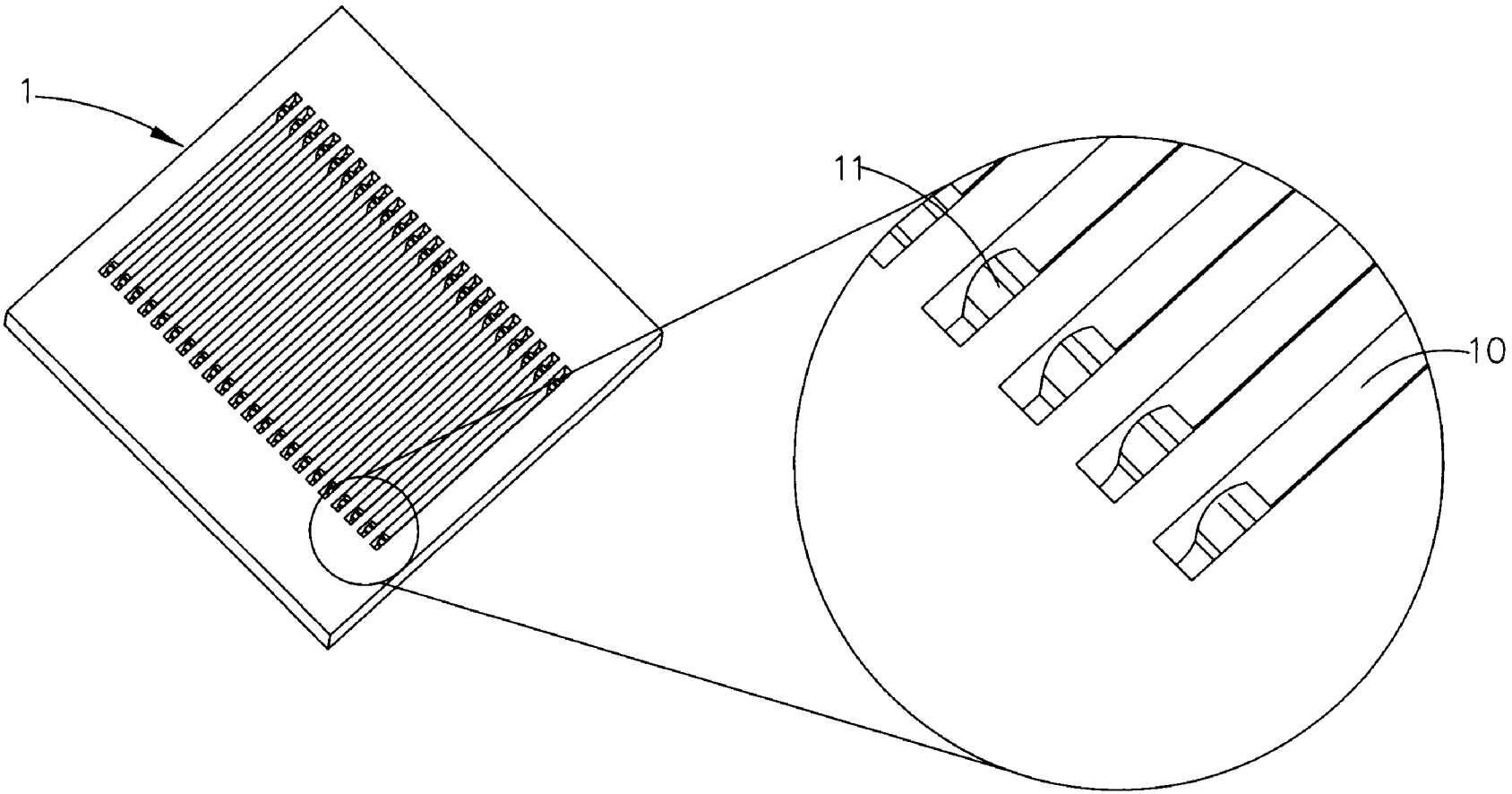
FIG. 2 schematically illustrates a perspective view of a preferred embodiment of the electrical insulating body of an electrical connector according to the present invention.
Figure 3:
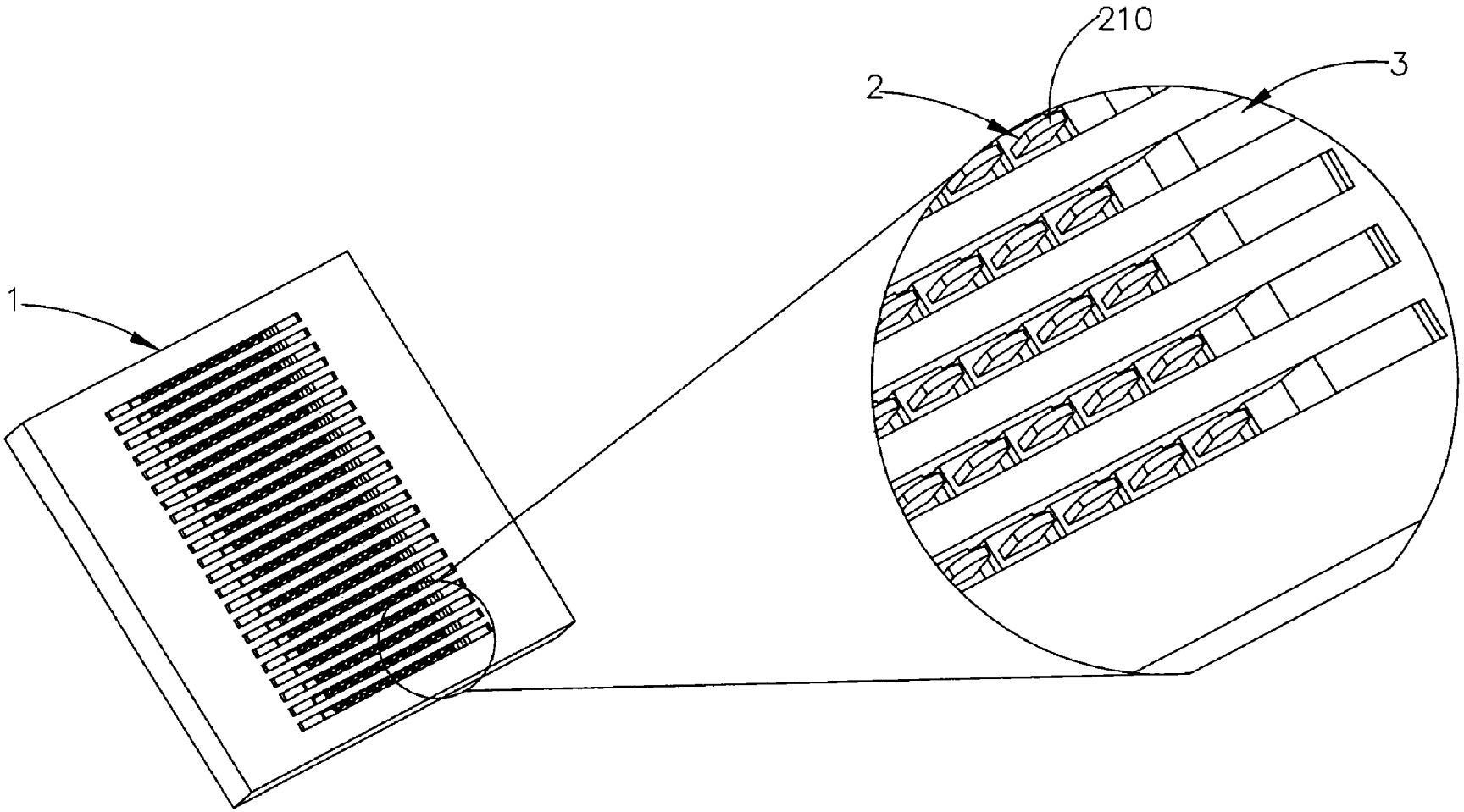
FIG. 3 schematically illustrates a perspective assembly view of an electrical connector according to the present invention.
Figure 4:
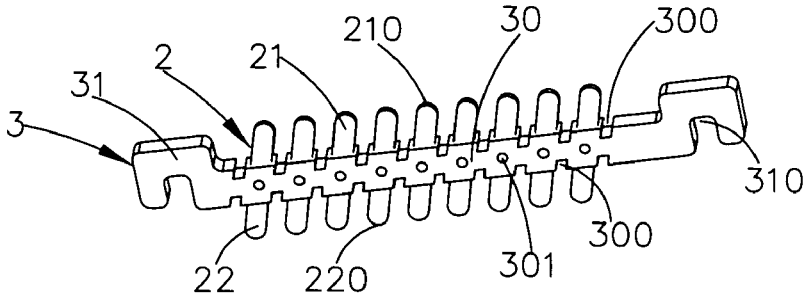
FIG. 4 schematically illustrates a perspective assembly view of the elastic plastics and the conductive terminal of an electrical connector according to the present invention.
Figure 5:
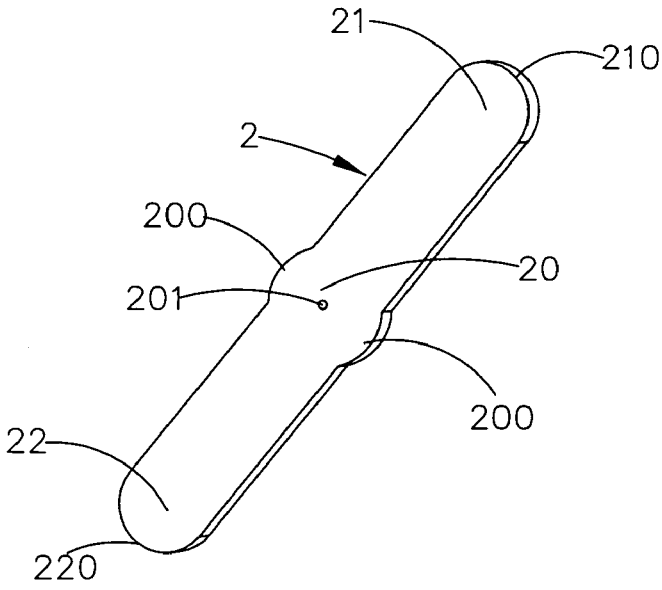
FIG. 5 schematically illustrates a perspective view of the conductive terminal of an electrical connector according to the present invention.
Figure 6:
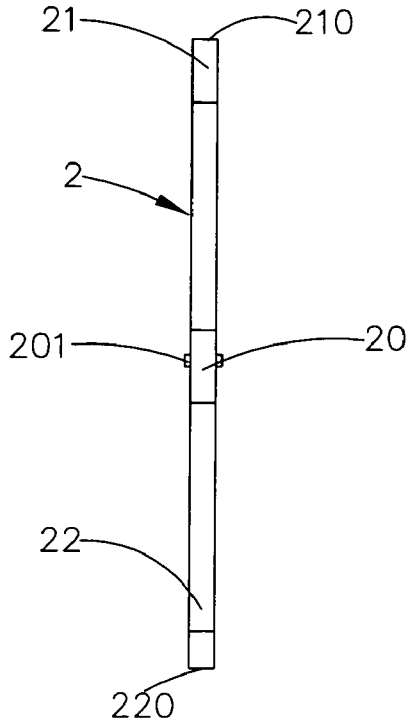
FIG. 6 schematically illustrates a side view of the conductive terminal of an electrical connector according to the present invention.

Referring to FIGS. 2 to 6, an electrical connector according to the present invention comprises an electrical insulating body 1, at least a conductive terminal 2 received in the terminal accommodating hole, and an elastic plastics.

The electrical insulating body 1 is largely a rectangular body provided with a plurality of terminal accommodating holes 10, each of which receives a plurality of conductive terminals 2. A plurality of the terminal accommodating holes constitute a conductive terminal accommodating zone and each terminal accommodating hole 10 transversally passes over the conductive terminal accommodating zone. Also, both ends of each terminal accommodating holes 10 described above are protrudingly provided with a protruding rib 11, respectively, of curved cross section.

The conductive terminals 2 are arranged in a planar form, comprising a retaining portion 20 and a upper and lower press contact portions 21 and 22 extending from both sides of the retaining portions 20, wherein both sides of the retaining portions 20 are protrudingly and outwardly provided with a interference portion 200, respectively, to interfere and secure the elastic plastics 3. Also, both sides of the center of the retaining portion 20 are provided with a protruding point 201, respectively, to retain with elastic plastics 3. The tops of the press contact portions 21 and 22 are provided with contact points 210 and 220, respectively. A line connecting the contact points 210 and 220 and the normal to the surface of the electrical insulating body 1 form a certain angle.

The elastic plastics 3 is a shape of long bar and received in the terminal accommodating hole 10 and located between the conductive terminal 2 and the terminal accommodating hole 10. The elastic plastics 3 covers the central portion of the electrical conductive terminal 2 and comprises a body 30 and a retaining portion 31 extending from both ends of the body 30.

The body 30 is cut to form a receiving space 300, which is located on upper and lower sides of the elastic plastics 3 and separated by the conductive terminals 2 to provide space for the conductive terminals 2 to rotate when it is under the pressure of a connected electronic device (not shown).

Furthermore, the body 30 is further provided with a circular hole 301 penetrating the side of the body 30. The circular hoe 301 corresponds to the conductive terminal 2 so as to secure the protruding point 201 of the conductive terminal 2. The thickness of the retaining portion 31 is apparently larger than that of the body 30 and is provided with a retaining groove 310 of a curved cross section. The protruding rib 11 is received and retained in the retaining groove 310 so as to secure the elastic plastics 3 and the electrical insulating body 1. The elastic plastics 3 and the conductive terminal 2 are jointed together by a circular clasping structure. In the present embodiment, the circular clasping structure is the interference portion 200 provided on both sides of the conductive terminal 2 (of course, in the present embodiment, it is possible, but not limited, to dispose a interference portion on the elastic plastics 3 and the conductive terminal 2 is provided with a accommodating portion corresponding to the interference portion).

When an electrical connector according to the present invention is being assembled, the conductive terminal 2 is first installed in the elastic plastics 3, which is then retained in the terminal accommodating hole 10. Consequently, when the conductive terminal 2 is under the pressure of the connected electronic device, the conductive terminal 2 will rotate along the circular hole 301 within the retreating space 300 available for the rotation of the conductive terminal 2. Also, the conductive terminal 2 may drive the surrounding elastic plastics 3 to rotate about the axis of the circular hole 301. When the pressure is being released, the elastic plastics 3 returns to its original position due to its elastic force, which also drive the conductive terminal 2 back to its original position. Consequently, the conductive terminal 2 may not show significant elastic fatigue after repetitive uses due to the presence of the elastic plastics 3. Also, the conductive terminal 2 may not exhibit large deformation and thus the stress concentration is low. Furthermore, high contact pressure on the conductive terminal 2 leads to a better electrical contact.

While the invention has been described with reference to the a preferred embodiment thereof, it is to be understood that modifications or variations may be easily made without departing from the spirit of this invention, which is defined by the appended claims.

What is claimed is:

1. An electrical connector comprising:

a) an electrical insulating body having a conductive terminal accommodating zone having a plurality of accommodating holes; and b) a plurality of elastic plastics, one of the plurality of elastic plastics is located in each of the plurality of accommodating holes, each elastic plastic of the plurality of elastic plastics having:

i) a receiving space;

ii) a plurality of pairs of holes spaced apart along opposing surfaces of the receiving space; and iii) a plurality of terminals spaced apart in the receiving space, each of the plurality of terminals having a first contact point located on a first end, a second contact point located on a second end, an interference portion located between the first and the second ends, the interference portion having two protruding points extending outwardly from opposing sides thereof and being inserted into one of the plurality of pairs of holes of the receiving space, wherein the plurality of terminals are pivotally connected in the receiving space via the plurality of pairs of holes, wherein the first and the second ends of each of the plurality of terminals extending outwardly from the elastic plastic.

2. The electrical connector as defined in claim 1, wherein the plurality of conductive terminals are arranged in a planar form.

* * * * *